US007270250B2

(12) United States Patent
Jones et al.

(10) Patent No.: US 7,270,250 B2
(45) Date of Patent: Sep. 18, 2007

(54) DISPOSABLE DISPENSER

(75) Inventors: Andrew Jones, St. Catharines (CA); Tony Kortleve-Snider, Beamsville (CA)

(73) Assignee: Hygiene-Tecknik Inc., Beamsville, Ontario (CA)

( * ) Notice: Subject to any disclaimer, the term of this patent is extended or adjusted under 35 U.S.C. 154(b) by 470 days.

(21) Appl. No.: 10/928,100

(22) Filed: Aug. 30, 2004

(65) Prior Publication Data

US 2006/0043114 A1 Mar. 2, 2006

(51) Int. Cl.
*B65D 5/64* (2006.01)

(52) U.S. Cl. ..... 222/173; 222/181.1

(58) Field of Classification Search ..... 222/173, 222/80, 180, 181.1, 181.2, 181.3, 108, 109, 222/194, 153.09, 621, 628
See application file for complete search history.

(56) References Cited

U.S. PATENT DOCUMENTS

| | | | | |
|---|---|---|---|---|
| 3,540,630 | A * | 11/1970 | Brown et al. | 222/153.03 |
| 4,360,130 | A | 11/1982 | Nishimura et al. | |
| 4,493,440 | A | 1/1985 | von Buelow et al. | |
| 4,673,109 | A | 6/1987 | Cassia | |
| 5,282,552 | A | 2/1994 | Ophardt | |
| 5,435,465 | A | 7/1995 | El-Amin | |
| 5,676,277 | A | 10/1997 | Ophardt | |
| 6,601,736 | B2 | 8/2003 | Ophardt et al. | |
| 6,729,502 | B2 * | 5/2004 | Lewis et al. | 222/181.3 |
| 6,877,642 | B1 * | 4/2005 | Maddox et al. | 222/181.3 |

FOREIGN PATENT DOCUMENTS

| | | |
|---|---|---|
| EP | 0209223 | 1/1987 |
| EP | 0455431 | 11/1991 |
| GB | 701223 | 12/1953 |
| GB | 1210515 | 10/1970 |
| GB | 1579617 | 11/1980 |
| GB | 2080884 | 2/1982 |
| GB | 2155435 | 9/1985 |
| GB | 2380470 | 4/2003 |
| WO | WO96/14938 | 5/1996 |
| WO | WO 02/49490 | 6/2002 |

* cited by examiner

*Primary Examiner*—Lien M. Ngo
(74) *Attorney, Agent, or Firm*—Riches, McKenzie & Herbert LLP

(57) ABSTRACT

A dispenser unit adapted for single use and preferably secured to a wall with a reusable wall plate. The dispensing unit is preferably an assembled unit which, as a unit, is mountable to and removable from the mounting plate, preferably with the assembled dispensing unit being separately functional and the mounting plate is preferably required merely for mounting of the dispensing unit to the wall.

28 Claims, 15 Drawing Sheets

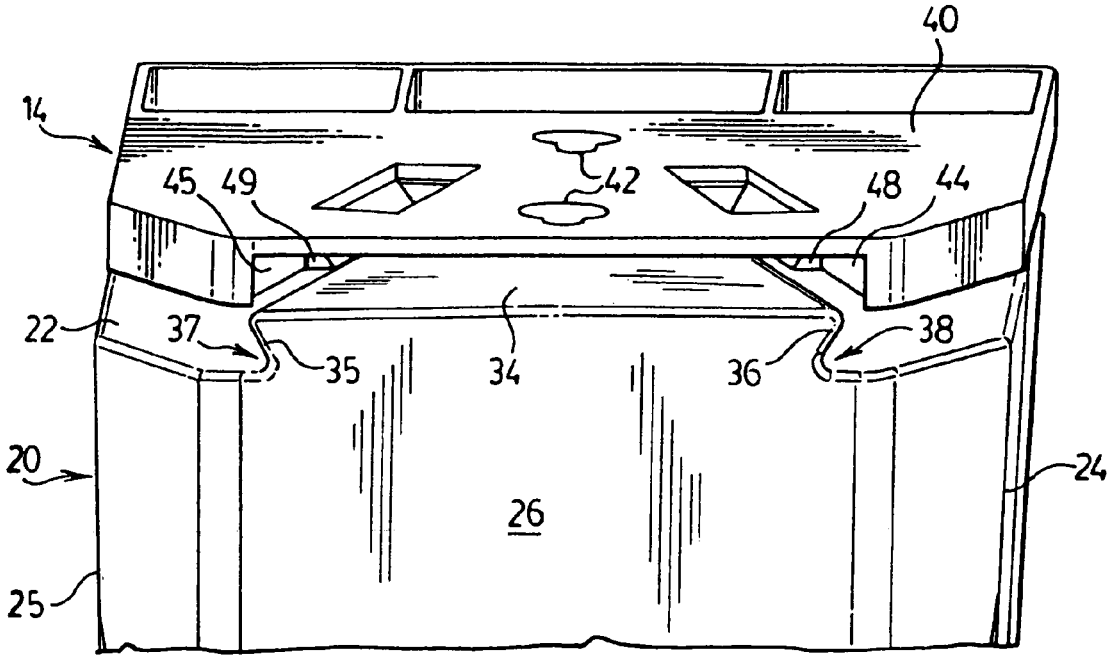
FIG.8.
FIG.9.
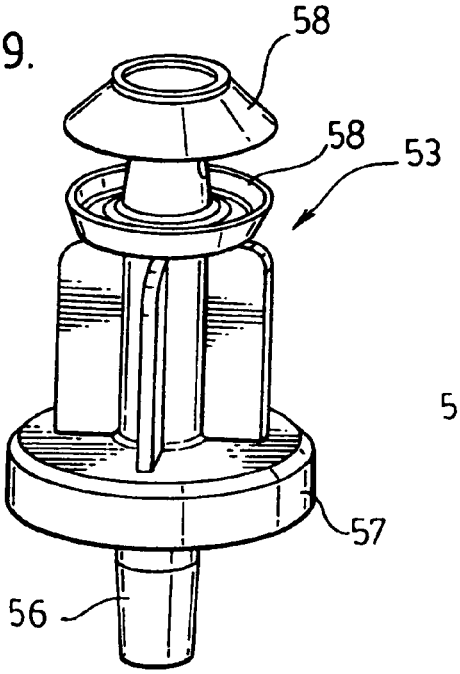
FIG.10.
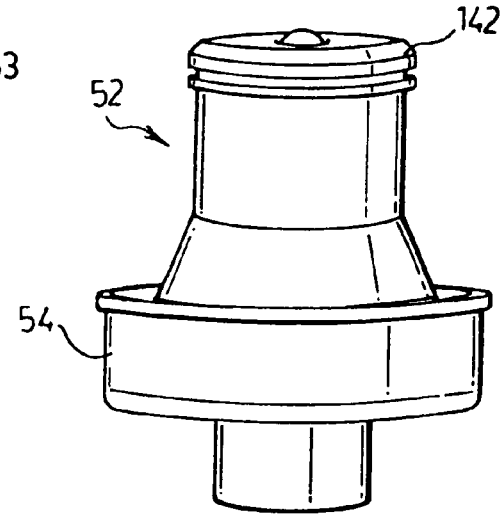

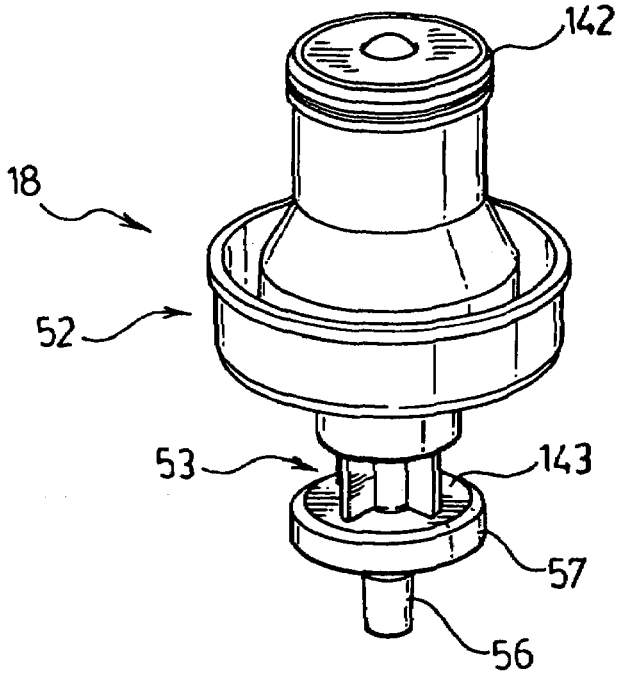
FIG.11.
FIG.12.
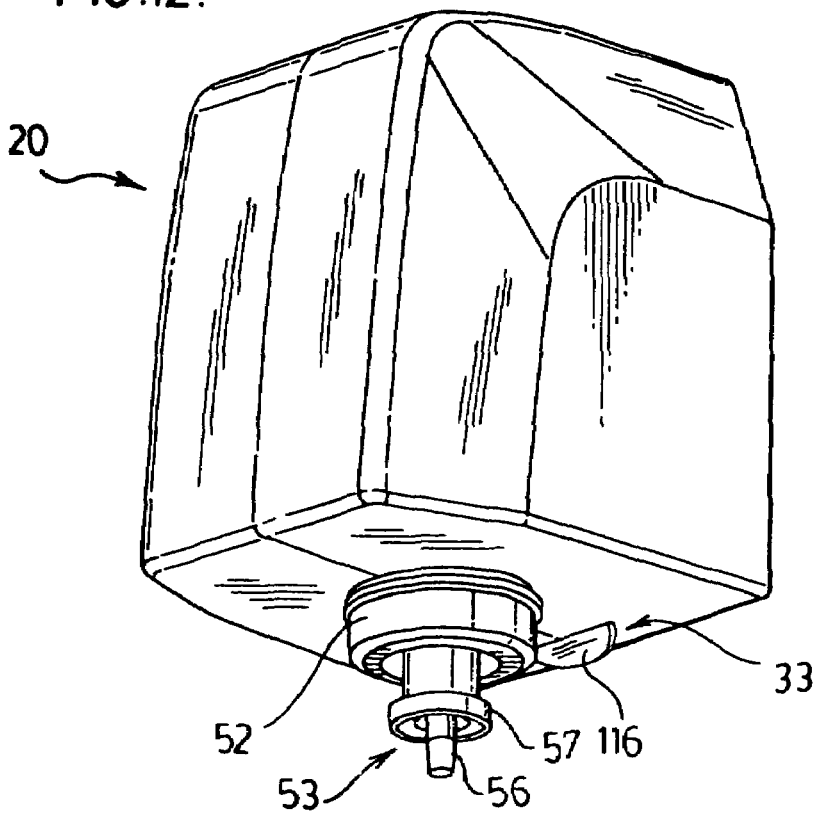

DISPOSABLE DISPENSER

SCOPE OF THE INVENTION

This invention relates to a disposable dispenser and, more particularly, to a disposable dispenser adapted for single use.

BACKGROUND OF THE INVENTION

Wall mounted soap dispensers for use in washrooms and the like are desired to meet high performance standards regarding dispensing in terms of reliability and in terms of the forces required to be manually applied for dispensing. As well, it is desired that such soap dispensers meet acceptable standards of appearance indicative of quality and reliability. Known soap dispensers which meet the standards of performance and appearance typically suffer the disadvantage that they are expensive and not practical to be discarded after a single use.

Known wall mounted soap dispensers are subject to regular vandalism in which they are physically removed from a wall and often destroyed. Presently known wall mounted soap dispensers do not typically provide practical solutions for use in situations where vandalism is expected to occur.

SUMMARY OF THE INVENTION

To at least partially overcome these disadvantages of previously known devices, the present invention provides a dispenser unit adapted for single use and preferably secured to a wall with a reusable wall plate.

The present invention provides a dispenser for flowable materials including a wall plate secured to a wall and a dispensing unit removably coupled to the wall plate. The dispensing unit is preferably an assembled unit which, as a unit, is mountable to and removable from the mounting plate, preferably with the assembled dispensing unit being separately functional and the mounting plate is preferably required merely for mounting of the dispensing unit to the wall.

The dispensing unit preferably comprises a reservoir bottle with an outlet opening, a piston pump assembly secured in the outlet opening of the reservoir bottle and an actuator member for manual engagement to activate the piston pump assembly and dispense fluid. The activator member is coupled to the reservoir bottle.

The dispensing unit, while coupled to the wall plate, is preferable not able to be disassembled. The dispensing unit must preferably be assembled before it is coupled to the wall plate and, once assembled, prevents or at least resists disassembly.

Preferably, the dispensing unit is removably coupled to the wall plate by engagement between the reservoir bottle and the wall plate.

Preferably, the bottle removably couples to the wall plate by vertical sliding of the bottle downwardly relative the wall plate. For example, laterally spaced and laterally extending catch members on the wall plate may be received in complementary laterally spaced and laterally extending slotways formed in a rearward portion of the bottle. The bottle preferably is formed by blow molding from a low density polyethylene and the laterally extending slotways may be formed in the rear portion of the bottle during blow molding.

Preferably, to reduce the cost of the dispensing unit, the activator member is formed from a minimal number of parts. The activator member has a support member fixedly coupled to the reservoir bottle about its outlet opening and a presser member engaging the piston and pivotally coupled to the support member for movement between an extended position and a retracted position with a spring member biasing the presser member to the extended position. Preferably, the actuator member comprises a unitary element injection molded from plastic and including as the unitary member, the support member and the presser member with the presser member coupled to the support member by a living hinge for pivoting about a hinge axis.

Various other functional features are preferably formed with the actuator member as part of the unitary element formed by injection molding from plastic. These other functional features include a mechanism for coupling of the actuator member to the bottle, a latch mechanism to retain the bottle on the actuator member against removal, catch fingers to couple a movable piston to the presser member, catch mechanisms to limit the relative extent of pivoting of the presser member relative to the support member, and the spring member to bias the support member and presser member apart.

Each component of the dispensing unit may preferably be formed from inexpensive plastic material, preferably low density polyethylene, such that after its single use, the assembled dispensing unit may be removed from the wall plate and be discarded and readily recycled.

In accordance with another aspect, the present invention provides a construction for a spring member which is adapted for manufacture from inexpensive plastic such as low density polyethylene and provide for acceptable resiliency and spring characteristics at least for a limited life of a single use product. The spring member preferably comprises an elongate cantilevered leaf spring member formed by plastic by injection molding as a unitary element depending on a support member for the spring. The spring member preferably has a cross-section normal to its longitudinal, at least proximate where it merges with its support member, of a U-shape with two legs joined by a bight and with the two legs being disposed substantially normal to the support surface. Preferably, the spring member is provided with resiliency substantially by resilient deflection of opposed portion of the two legs towards and away from each other. The spring member may preferably be provided in conjunction with a ramp-like slideway provided on another member which a distal end of the spring member is to engage. The slideway is being disposed such that the spring member on deflecting from an undeflected position to deflected positions slides longitudinally along the slideway. The slideway is preferably disposed so as to assist in reducing the deflection required of the spring member.

The present invention provides for an arrangement for improved engagement and locking of a bottle to a support member. An elongate opening is provided in a support shelf of the support member having an enlarged portion at one end of the elongate opening and with the elongate opening reducing to a smaller portion at its other end. The neck of a bottle is adapted to pass through the enlarged portion of the opening and then to be slid laterally such that an annular groove about the neck of the bottle is tightly engaged in the smaller portion of the opening. Preferably, deflectable fingers are provided on either side of the smaller portion to secure the neck of the bottle therein in a substantially snap-fit relation. A catch member is provided on a bottom surface of the bottle spaced from the neck which catch member adapted to become engaged inside the enlarged portion of the opening and prevent sliding of the bottle in a direction opposite to the direction required for insertion of the neck into the smaller portion of the opening. The catch member preferably has a surface which corresponds substantially identical to the interior surface of the enlarged portion of the opening to assist in holding the bottle secured to the support shelf in a desired centered position and against relative rotation or side to side movement.

In one aspect, the present invention provides a dispenser for flowable materials comprising:

a wall plate for mounting to a wall;

a dispensing unit for removably mounting to the wall plate;

the dispensing unit comprising an assembly of:

a bottle-like reservoir having an exit opening, a piston pump mechanism having a piston chamber forming element coupled to the opening of the reservoir and a piston member reciprocally slidable in the piston chamber forming element for reciprocal sliding to dispense flowable material from the reservoir through an extension of the piston member extending outwardly from the piston chamber forming element, an actuator member having a support member fixedly coupled to the reservoir about its opening and a presser member engaging the piston extension and pivotally coupled to the support member for movement between an extended position and a retracted position, with a spring member biasing the presser member to the extended position, wherein manual movement of the presser member between an extended and a retracted position slides the piston member in the piston chamber forming element to dispense flowable material from the extension of the piston element.

Preferably, while the dispensing unit is coupled to the wall plate, the dispensing unit cannot be disassembled.

BRIEF DESCRIPTION OF THE DRAWINGS

Further aspects and advantages of the present invention will become apparent from the following description taken together with the accompanying drawings in which:

FIG. 8 is a pictorial top view of the dispenser as shown in FIG. 1 with the bottle in the position of being inserted onto the wall;

FIG. 9 is a pictorial view of a piston member used in the embodiment of FIG. 1;

FIG. 10 is a pictorial view of a piston chamber forming element used in the embodiment of FIG. 1;

FIG. 11 is a pictorial view of an assembled pump mechanism formed by assembly of the piston member of FIG. 9 and the piston chamber forming member of FIG. 10;

FIG. 12 is a pictorial view of the bottle of FIG. 4 with the pump mechanism of FIG. 11 coupled thereto;

DETAILED DESCRIPTION OF THE DRAWINGS

Figure 1:
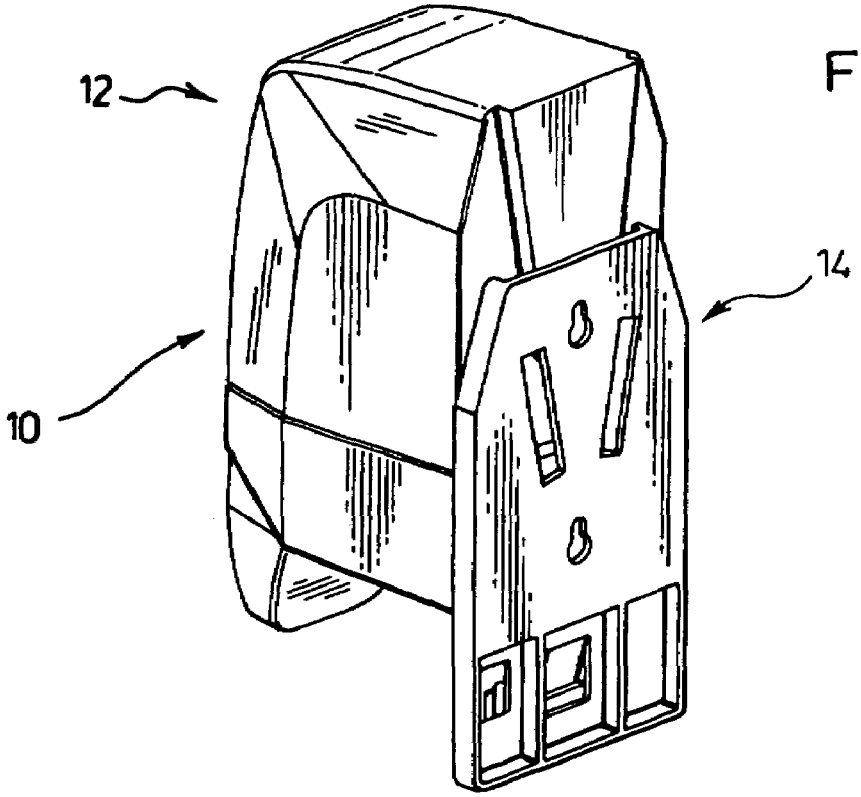
FIG. 1 is a schematic rear perspective view showing a dispenser in accordance with the first embodiment of the present invention with an assembled dispensing unit in the process of being mounted to a wall plate.
Figure 2:
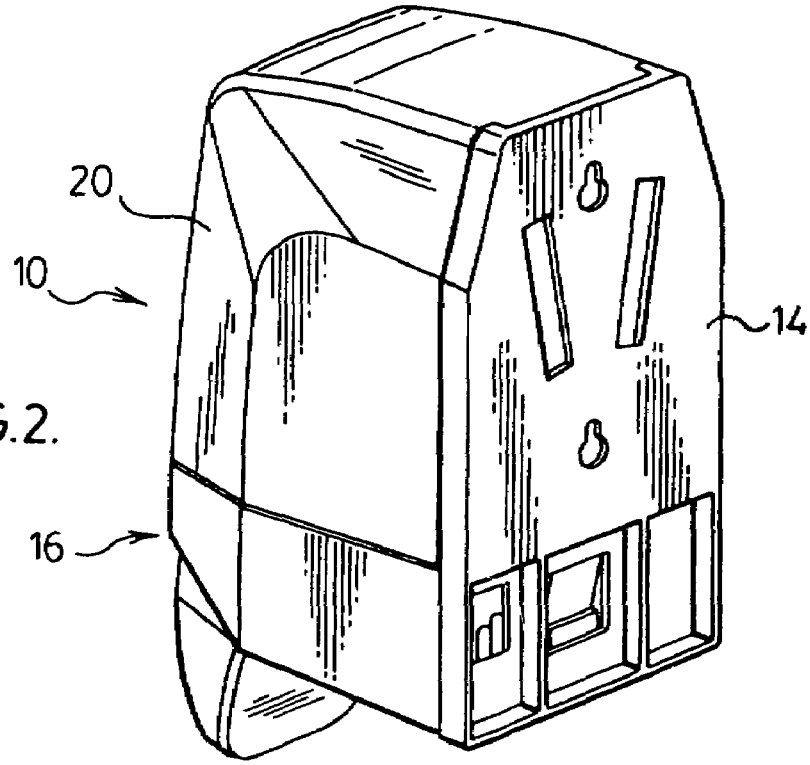
FIG. 2 shows a schematic pictorial rear and side view of the dispenser of FIG. 1 from above with the dispensing unit fully mounted on the wall plate.
Figure 3:
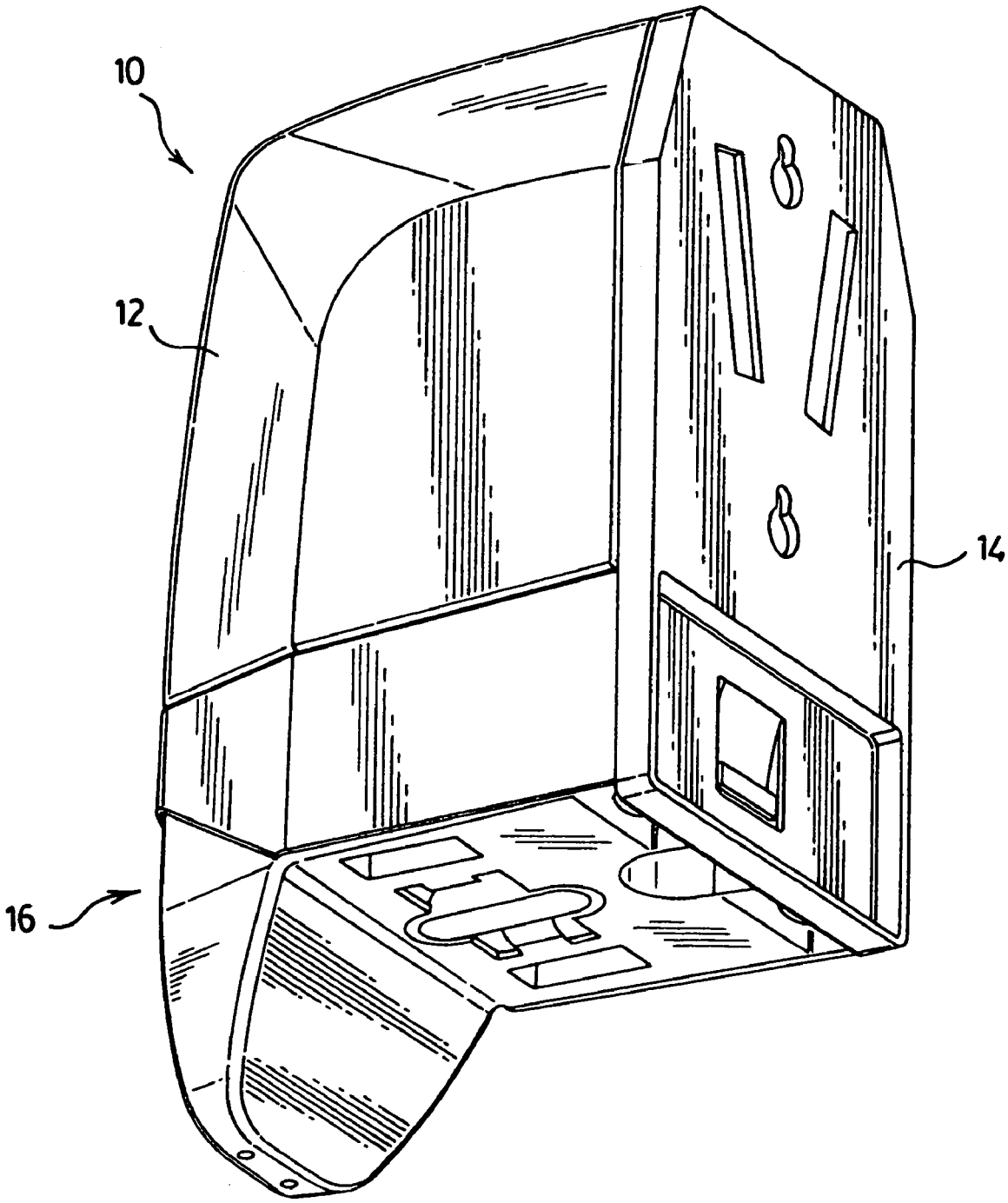
FIG. 3 shows a schematic pictorial rear and side view of the dispenser of FIG. 2 from below.

Reference is made to the Figures which show a soap dispenser 10 comprising a dispensing unit 12 removably coupled to a wall plate 14. The dispensing unit 12 comprises an assembly of a reservoir bottle 20, a piston pump mechanism 18 and an activator member 16.

Bottle

Figure 4:
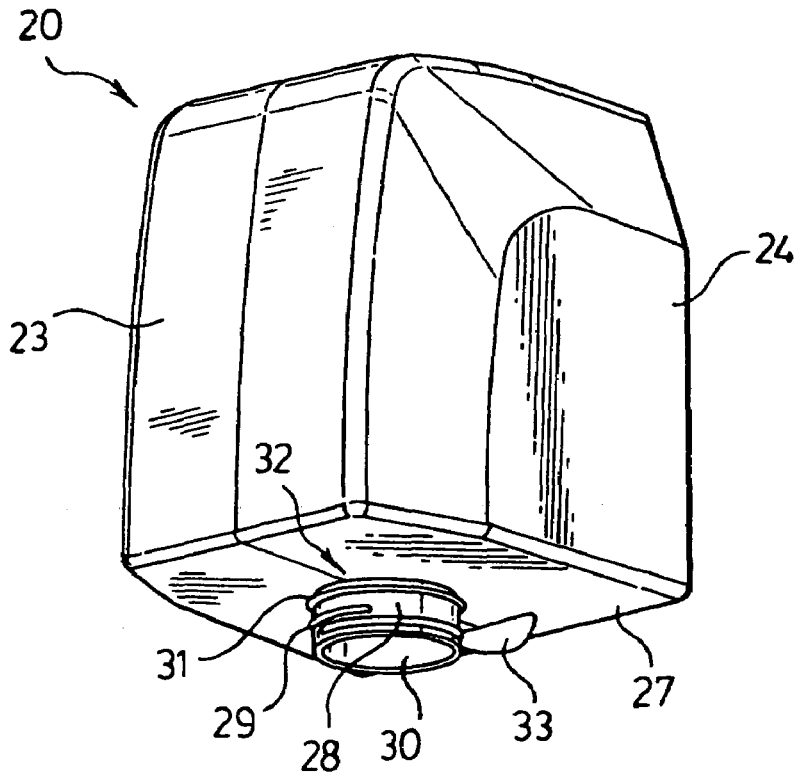
FIG. 4 shows a pictorial bottom and front view of the bottle of the dispenser of FIG. 1 from below.
Figure 5:
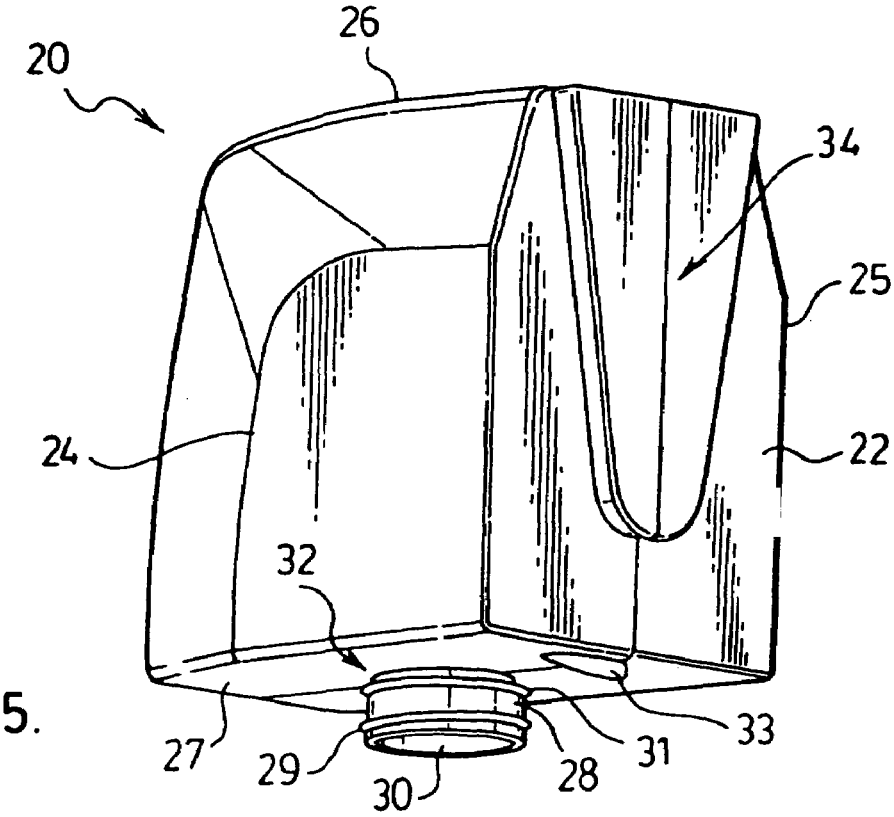
FIG. 5 is a pictorial bottom and rear view of the bottle of FIG. 4 from below.
Figure 6:
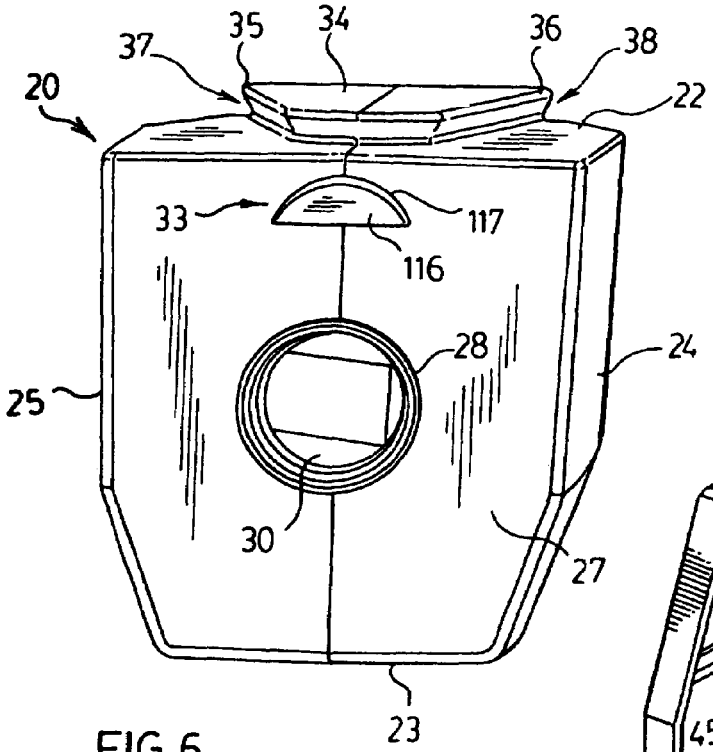
FIG. 6 is a pictorial bottom view of the bottle of FIG. 4.

The reservoir bottle 20 is best shown in FIGS. 4 to 6. The bottle 20 has a rear wall 22, a forward wall 23, two side walls 24 and 25, a top wall 26 and a bottom wall 27. A cylindrical externally threaded neck 28 carrying helical threads 29 extends downwardly from the bottom wall 27 and provides an exit opening 30 for communication with the interior of the bottle.

The neck 28 also carries an annular flange 31 spaced a uniform distance from the bottom wall 27 so as to provide an annular slotway 32 therebetween adapted for coupling the bottle 20 to the activator member 16.

The bottom wall 27 has a catch ramp 33 to engage the activator member 16 in a manner to resist uncoupling of the bottle 20 from the actuator member 16.

The rear wall 22 of the bottle carries a mounting wedge 34 which has spaced side walls 35 and 36, best seen in FIGS. 6 and 8, which are undercut in the sense that they provide laterally inwardly extending slotways 37 and 38 for coupling of the bottle to the wall plate 14.

The configuration of the mounting wedge 34 is preferably adapted to facilitate manufacture of the bottle 20 by blow molding from relatively inexpensive plastic materials such as polyethylene, preferably low density polyethylene yet provide for secure coupling of the bottle 20 to the wall plate 14.

Wall Plate

Figure 7:
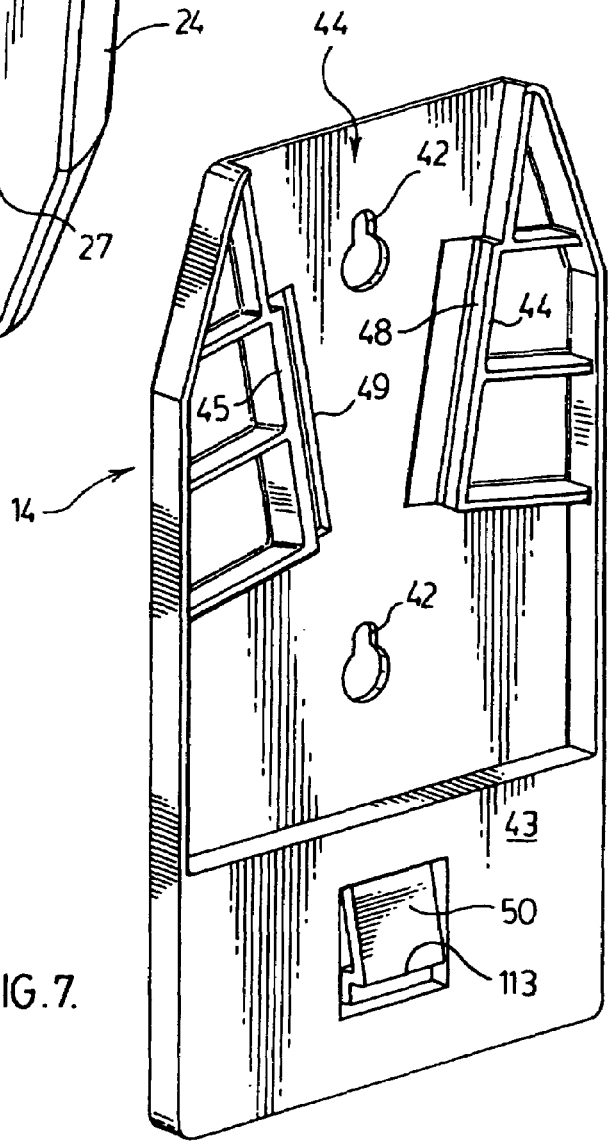
FIG. 7 is a pictorial front view of the wall plate of the dispenser of FIG. 1.

The wall plate 14 is best seen in FIGS. 7 and 8. The wall plate has a planar rear surface 40 for engagement as, for example, with a washroom wall proximate a sink. The wall plate 14 may be secured to the wall by known means, preferably, by adhesives such as two-sided adhesive tape or fasteners such as screws. Openings 42 to receive such fasteners are shown to extend through the wall plate 14.

The forward surface 43 of the wall plate carries a wedge-shaped slot 44 defined between two angled shoulder forming members 45 and 46 which each present a laterally and inwardly extending catch member 48 and 49 which are adapted to be received in the slotways 37 and 38 of the bottle 20. The slot 44 is complementary in size and shape to the mounting wedge 34 on the bottle.

The bottle 20 is removably mounted to the wall plate 14 by aligning the mounting wedge 34 on the bottle 20 with the groove 44 on the wall plate 14 and sliding the bottle 20 vertically downwardly. The wall plate 14 preferably carries a resilient deflectable cantilevered shoulder carrying latch finger 50 adapted to releaseably lock the wall plate 14 to the activator member 16.

As seen in FIG. 8, the mounting wedge 34 on the bottle 20 provides a dovetail-like member to be received in the dovetail-like slot 44 in the wall plate 14.

Pump Mechanism

As seen schematically in FIGS. 9 to 12, the pump mechanism 18 comprises a piston chamber forming element 52 and a piston member 53. The piston chamber forming element 52 is adapted to be sealably engaged in the exit opening 30 of the bottle 20 by reason of an internally threaded flange 54 threadably engaging the threaded neck 28 of the bottle 20 and locating the piston chamber forming element coaxially within the neck 28. The piston member 53 is axially slidably received in the piston chamber forming element 52 for axial sliding therein coaxially between an extended position and a retracted position to dispense flowable materials from the bottle 20.

Figure 21:
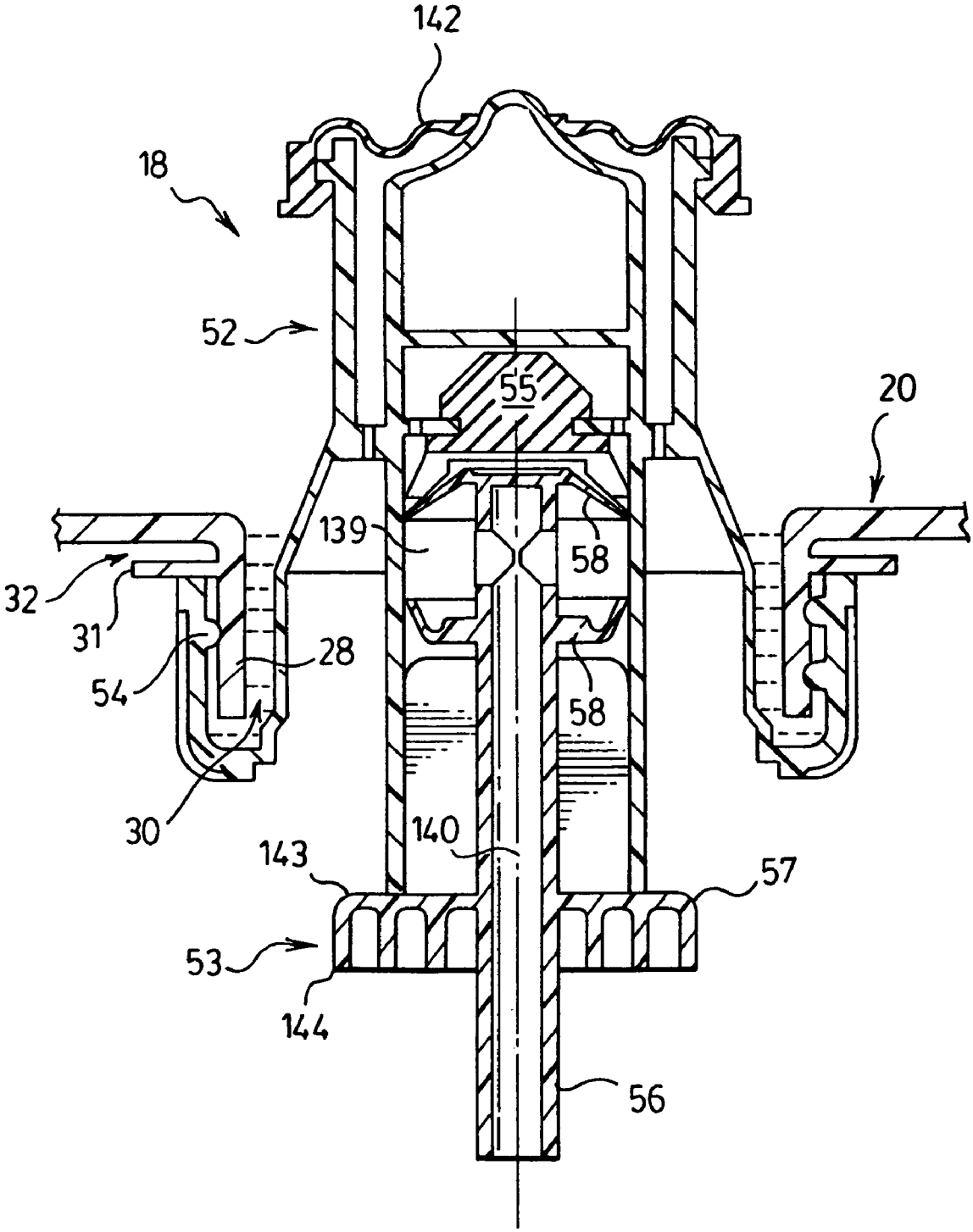
FIGS. 21 and 22 are cross-sectional side views through the pump assembly and bottle as shown in FIG. 12 through cross-sections coaxial with the neck of the bottle and including but a small section of the bottom wall of the bottle.
Figure 22:
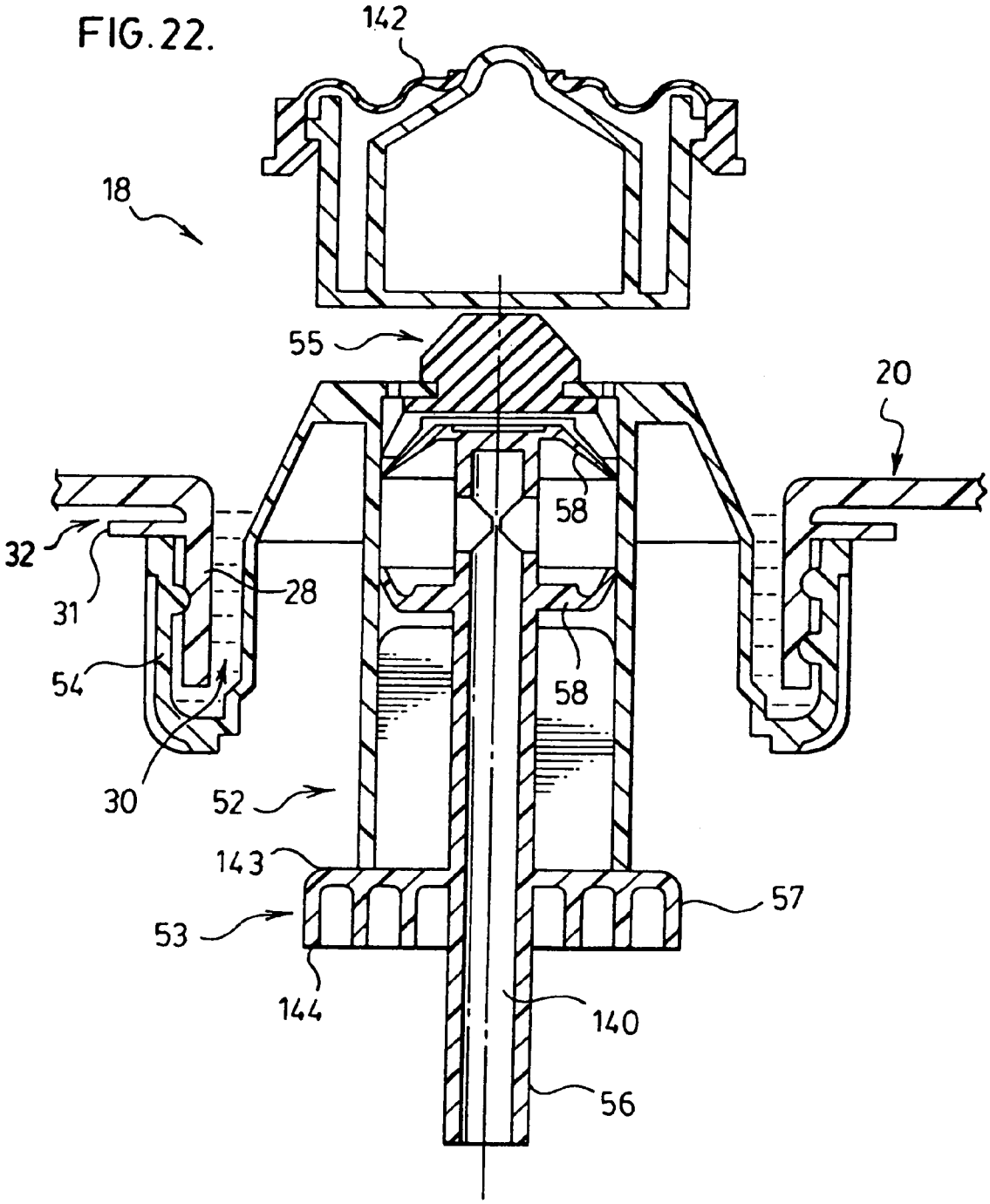

FIGS. 21 and 22 show cross-sectional views of a complete pump mechanism 18 coupled to the bottle 20 shown schematically. The piston chamber forming element 52 carries one-way inlet valve 55 via which material in the bottle may pass into a chamber 139 inside the piston chamber forming element 53. The piston member 53 has an outlet extension tube 56 extending outwardly from the piston chamber forming element 52 and carrying an annular engagement flange 57 for engagement to reciprocally move the piston member 53. The piston member 53 has radially outwardly directed flanges 58 to interact with the chamber 139 inside the piston chamber forming element 52 so as to dispense material out through an outlet passageway 140 centrally through the outlet extension tube 56. The piston pump mechanism 18 preferably includes a resilient air relief valve 142 to permit air to enter the bottle 20 to replace material dispensed as when vacuum conditions are created inside the bottle 20 which is preferably configured to be rigid or substantially non-collapsible.

The pump mechanism illustrated is of a type similar to that disclosed in the applicant's U.S. Pat. No. 5,282,522, issued Feb. 1, 1994, the disclosure of which is incorporated herein by reference. Various other similar piston pumps may be used as, for example, disclosed in the applicant's U.S. Pat. No. 5,676,277, issued Oct. 14, 1997 preferably for dispensing liquids and U.S. Pat. No. 6,601,736, issued Aug. 5, 2003 preferably for dispensing foam liquid, the disclosures of which are incorporated herein by reference. Other similar piston pump mechanisms adapted for coupling to the outlet of bottles are well known. It is preferred to adopt pump mechanisms which are made entirely out of plastic and do not incorporate any metal components. The pump mechanisms may include pump mechanisms which permit dispensing of more than one component in a dispensing stroke and may dispense flowable solid and grit-like materials alone or in combination with paste, liquids or flowable materials or foamed liquids. As well, the pump mechanism may provide a nozzle at the end of the extension tube 56 which provides for spraying of the fluid dispensed.

Actuator Member

Figure 13:
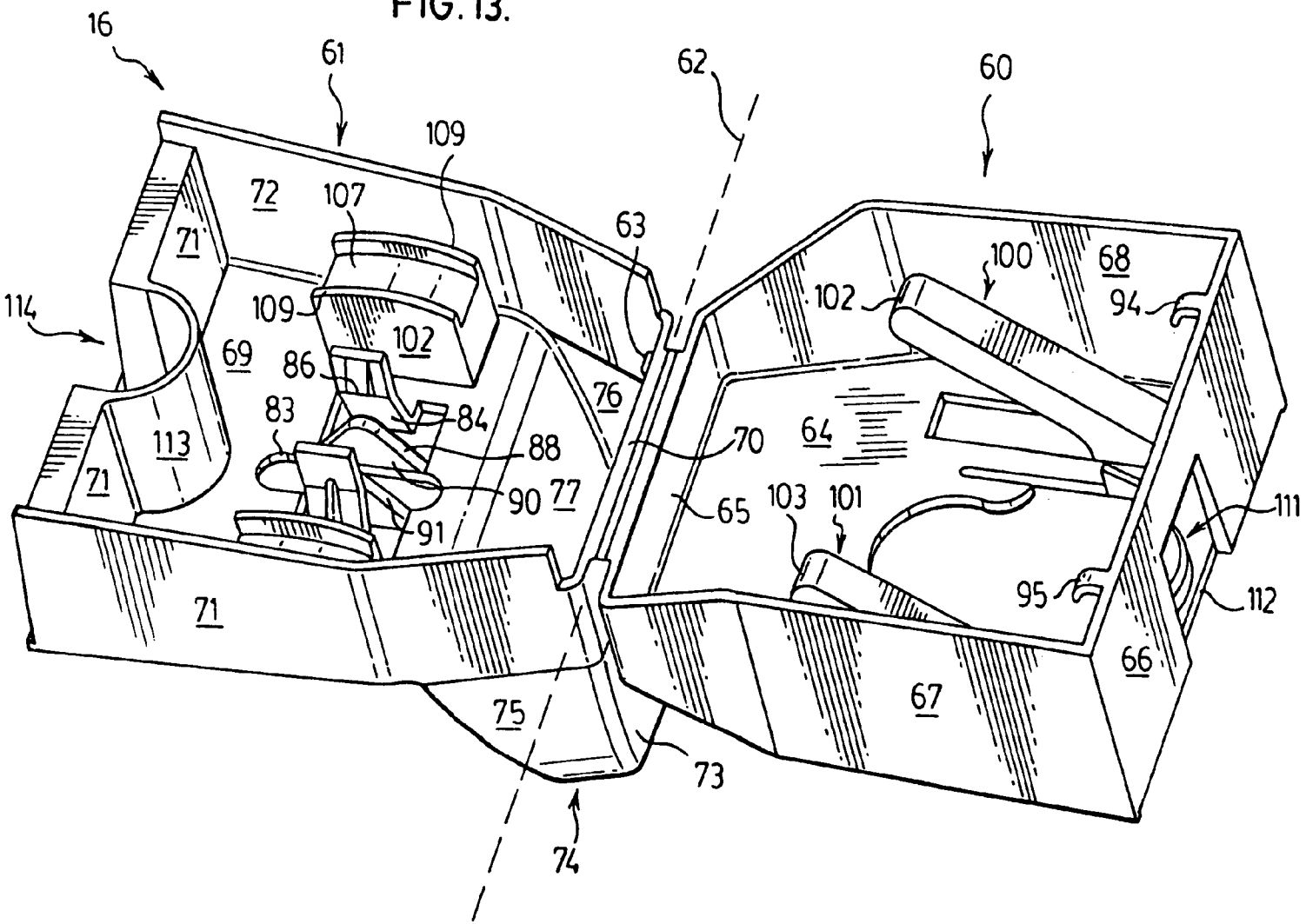
FIG. 13 is a pictorial view of the actuator member of the dispenser of FIG. 1 in an open position.
Figure 14:
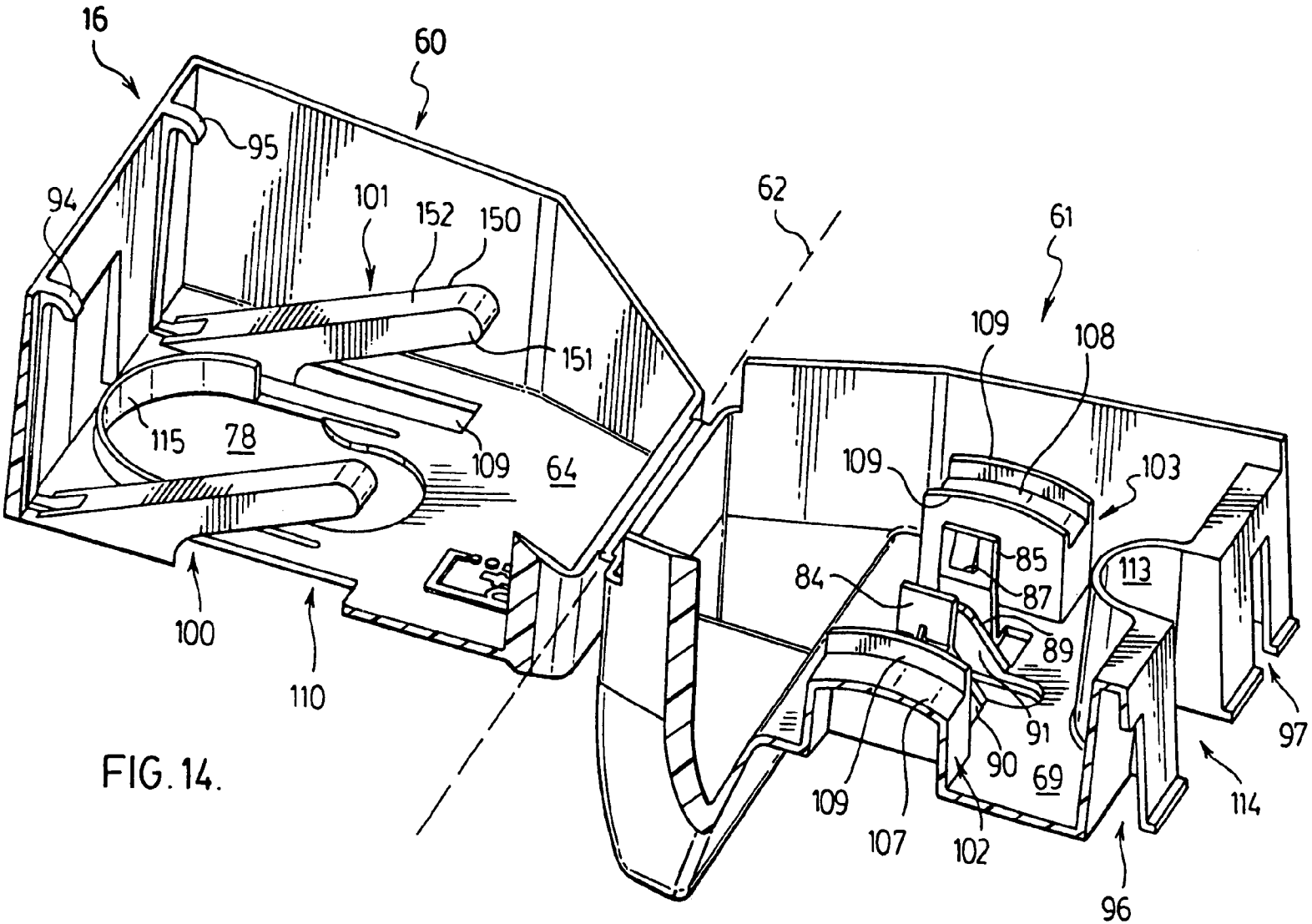
FIG. 14 is a partially cross-sectioned pictorial view of the actuator of FIG. 13 as viewed from the other side of the actuator to that viewed in FIG. 13.
Figure 15:
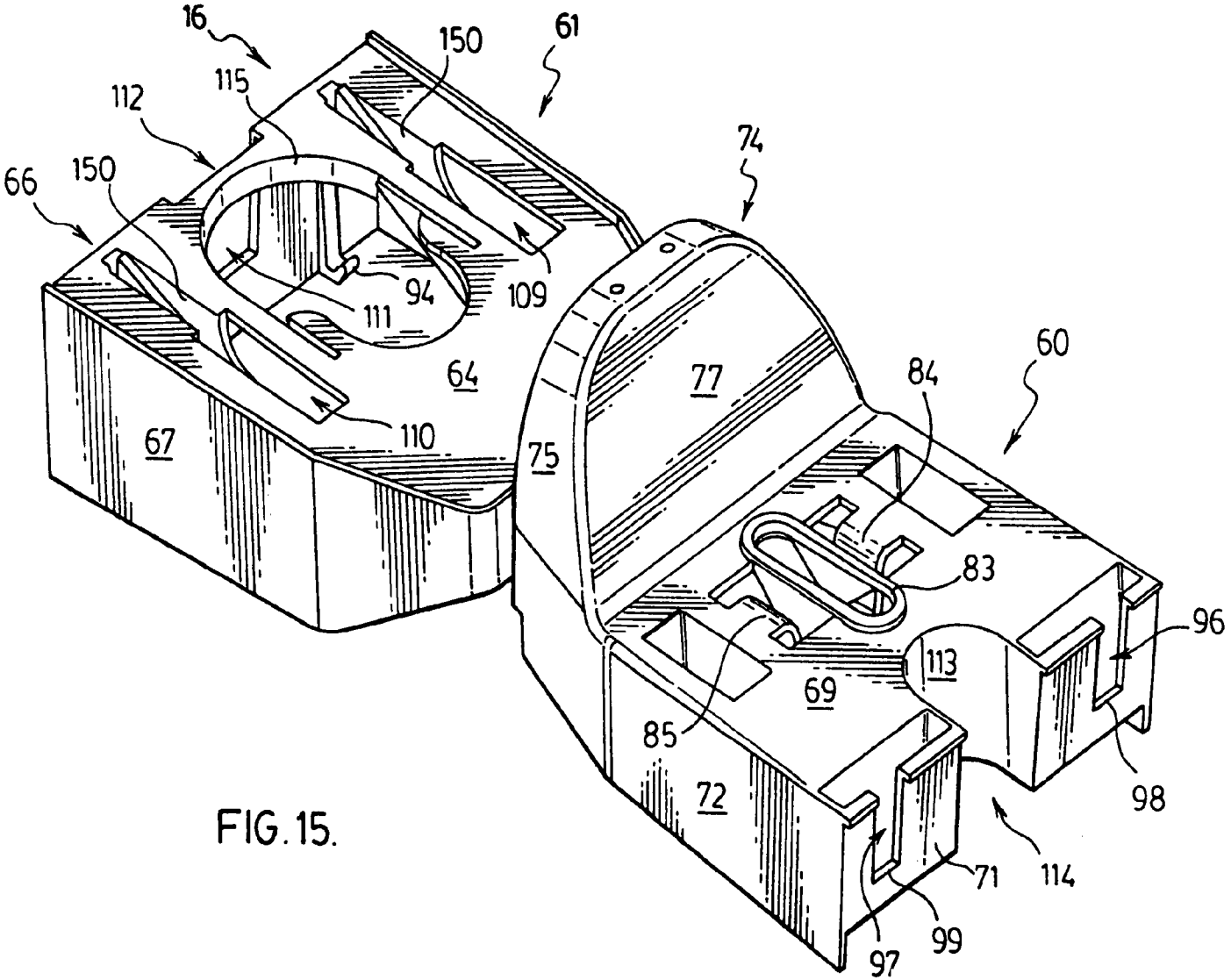
FIG. 15 is a pictorial view of the underside of the actuator member shown in FIG. 13.

The actuator member 16 is shown in FIGS. 13 to 19. The actuator member 16 in the preferred embodiment comprises a unitary element preferably injection molded from plastic. The actuator member comprises a support member 60 and a presser member 61 pivotally coupled together for pivoting about a hinge axis 62 by a living hinge 63 which is a thin plate of plastic which bridges between the support member 60 and the presser member 61. The activator member 16 is shown in FIGS. 13, 14 and 15 with the support member 60 and the presser member 61 disposed about the hinge axis 62 in an open position, being a position in which the activator member is preferably formed during injection molding. From the open position shown in FIGS. 13 to 15, the actuator member is folded about the hinge axis 62 to assume closed, operative positions for dispensing use as shown in FIGS. 16 to 19.

Figure 16:
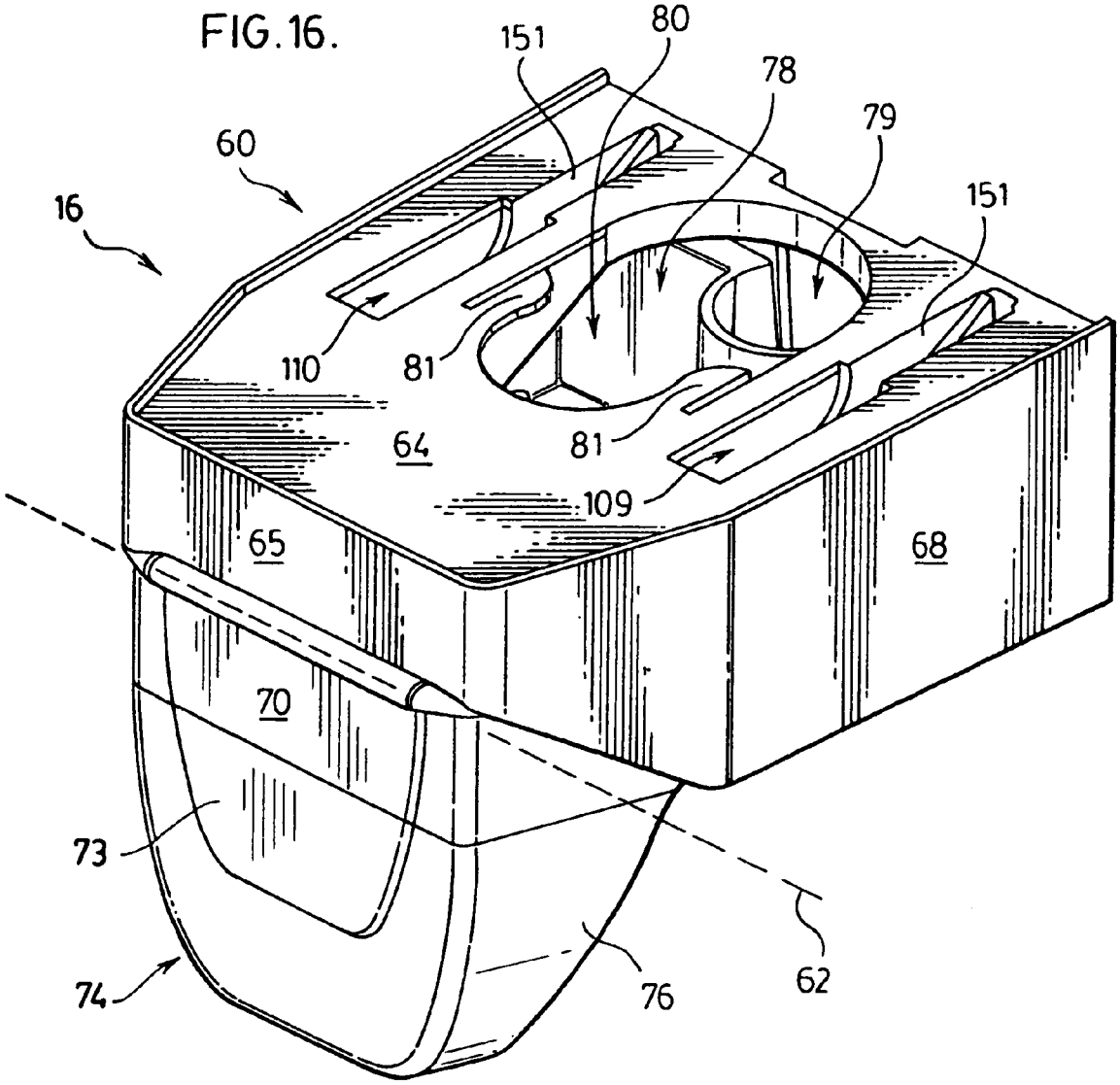
FIG. 16 is a pictorial view of the actuator of FIG. 13 in a closed position.
Figure 17:
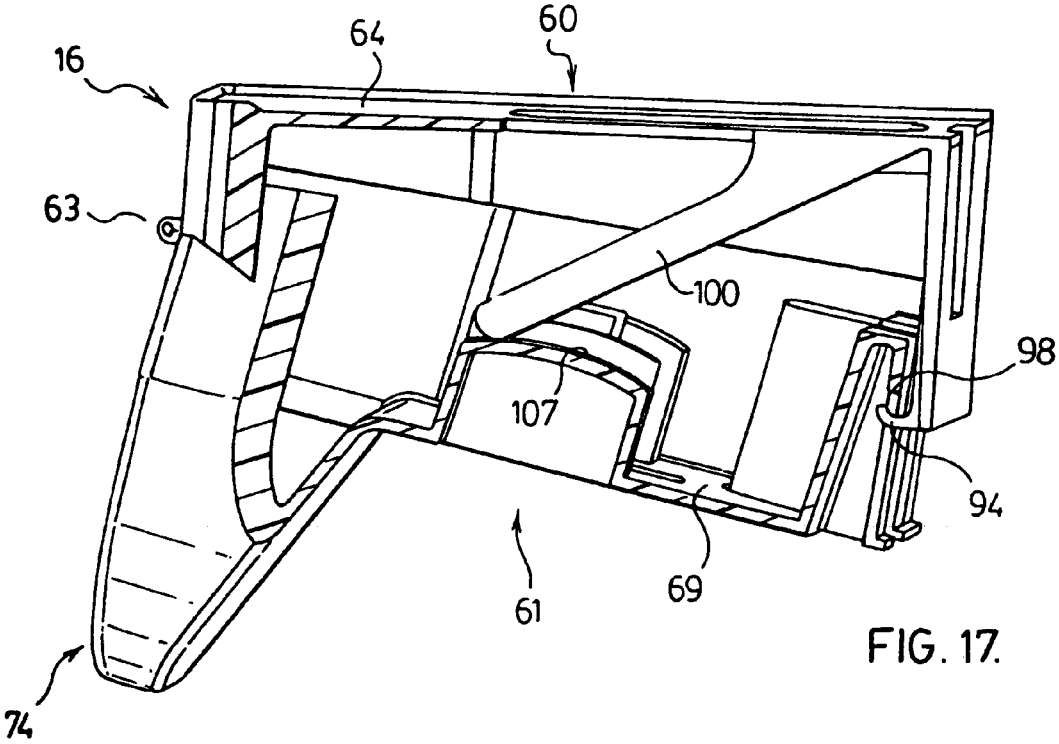
FIG. 17 is a cross-sectional side view of the actuator of FIG. 16 as cross-sectioned adjacent one spring member.
Figure 18:
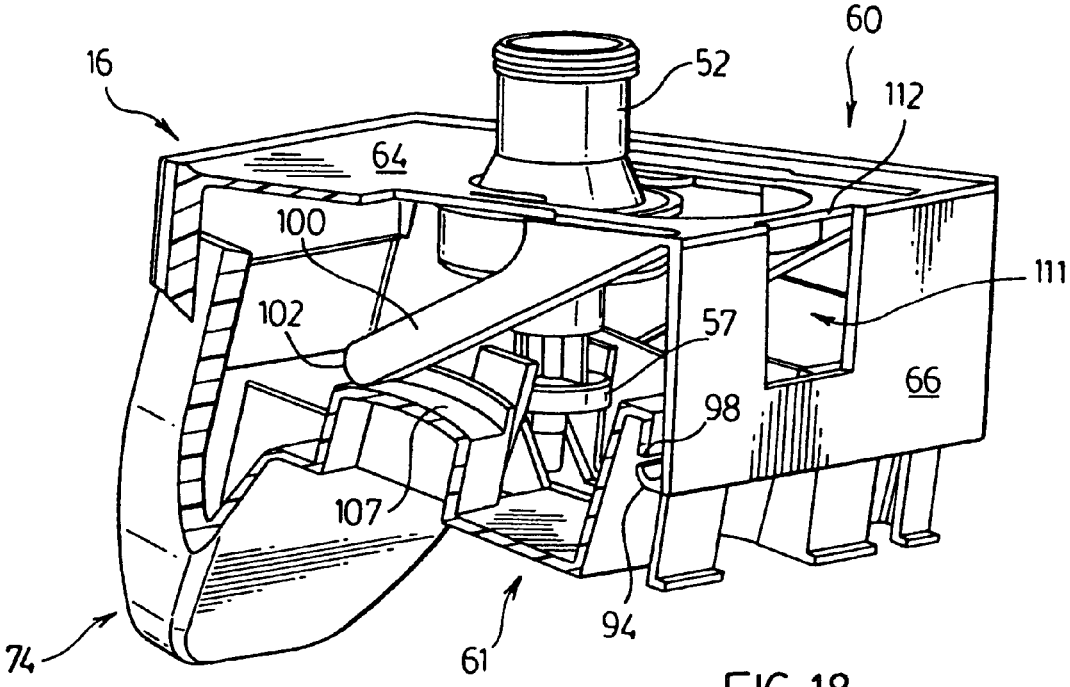
FIG. 18 is a pictorial partially cross-section side view of the actuator member shown in FIG. 16 in a fully extended position and showing the location of the pump mechanism of FIG. 11 if the pump mechanism were received within a bottle coupled to the actuator member.
Figure 19:
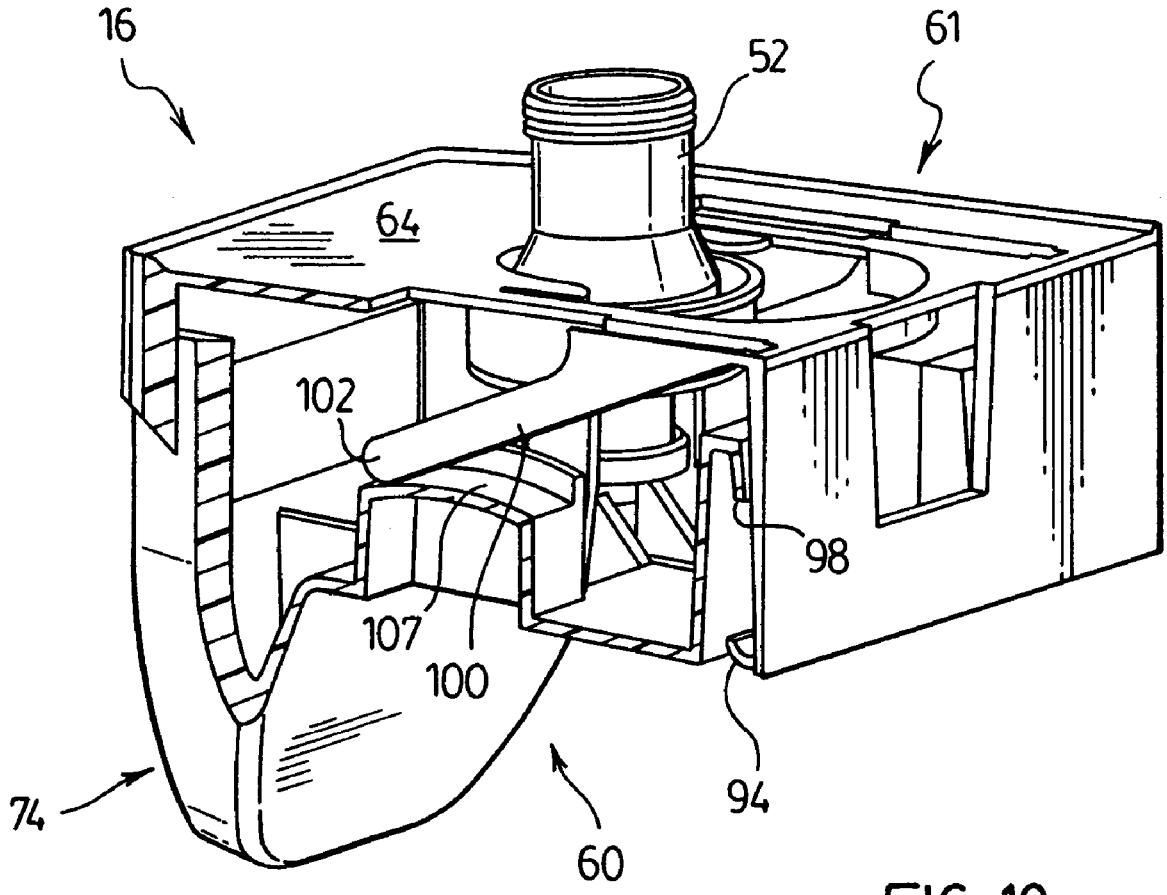
FIG. 19 is a view the same as that of FIG. 17, however, with the actuator member in a retracted position.
Figure 20:
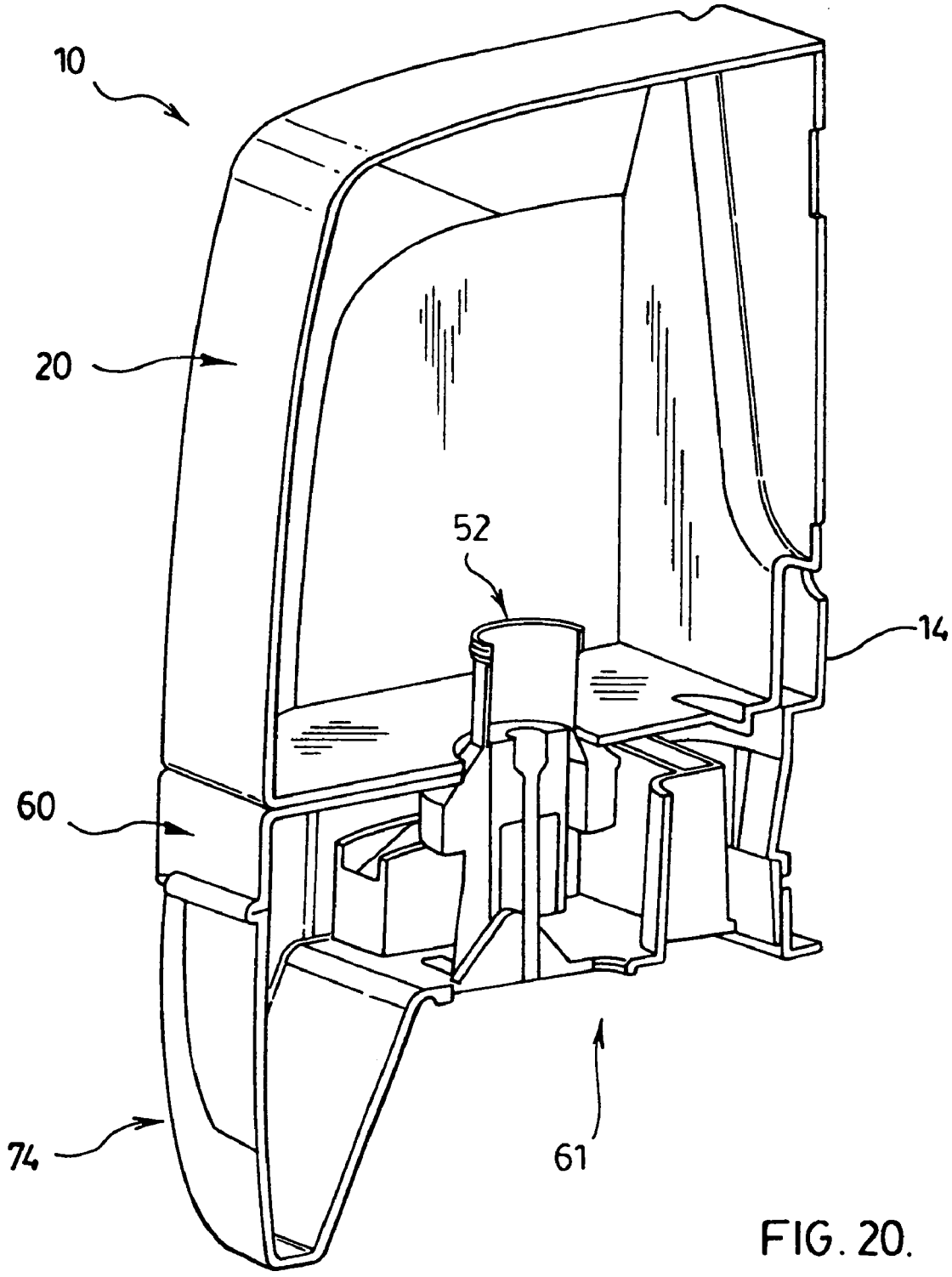
FIG. 20 is a schematic cross-section pictorial view of the dispenser shown in FIG. 2 along a central plane vertically through the dispenser.

The closed, operative position illustrated in FIGS. 16 to 19 represent a fully extended position in FIGS. 16, 17 and 18 and a retracted position in FIG. 19 effectively showing the relative range of pivoting of the support member 60 and the presser member 61 in normal operation to dispense fluid.

As shown in FIG. 13, the support member 60 has an open box-like structure with a support shelf 64 from which interconnected front wall 65, rear wall 66 and side walls 67 and 68 depend upwardly as shown. Similarly, the presser member 61 has an open box-like structure with a support shelf 69 from which interconnected front wall 70, rear wall 71 and side walls 71 and 72 depend upwardly as shown. In the presser member 61, the front wall 70 also extends downwardly beyond the shelf 69 as a front wall engagement portion 73 of a hand lever 74 having side wall portions 75 and 76 which extend downwardly from the side walls 71 and 72. A rear wall 77 of the hand lever 74 closes the rear of the hand lever 74 bridging between the engagement portion 73 and the shelf 69 and between the side wall portions 75 and 76.

As best seen in FIG. 16, the support shelf 64 of the support member 60 has an elongate opening 78 therethrough comprising an enlarged entry portion 79 at a rear end of the opening 78 and a smaller snap opening 80 at a forward end of the opening 78. Two resilient fingers are provided on either side of a rear entranceway to the snap opening 80. The snap opening 80 is adapted to be received in the slotway 32 about the neck 28 of the bottle 20 to couple the bottle 20 to the support member 60 with the resilient fingers 81 to deflect outwardly to permit the neck 28 of the bottle 20 to enter into the snap opening 80 and with the fingers 81 to assume their undeflected condition and maintain the neck 28 of the bottle securely and fixedly received within the snap opening 80 and with the bottom wall 77 of the bottle 20 supported on the support shelf 64.

In assembly of the dispensing unit 12, the piston pump mechanism 18 is coupled to the bottle 20 by threadably engaging the piston chamber forming element 52 onto the threaded neck 28 of the bottle with the piston member 53 received in the piston chamber forming element 52. The sub-assembly of the bottle 20 and the pump mechanism 18 is then coupled to the actuator member 16 by the neck 28 of the bottle carrying the piston chamber forming element 53 thereabout being inserted downwardly through the enlarged entry portion 79 of the opening 78 until the support shelf 64 is in alignment with the slotway 32 on the neck 28 between the annular flange 31 and the bottom wall 27 of the bottle. Subsequently, the bottle is moved forwardly relative to the support shelf 64 such that the snap opening 80 engages in the slotway 32 about the neck and securely engages the bottle 20 to the support member 60.

Piston Catch Fingers

The shelf 69 of the presser member 61 carries an elongate opening 83 through which the nozzle or outlet extension tube 56 of the piston member 53 is to extend.

On either side of the opening 83, the shelf 69 carries two resilient piston catch fingers 84 and 85 which are to engage the engagement flange 57 of the piston member 53 to couple the piston member 53 for movement with the presser member 61. The catch fingers 84 and 85 carry a downwardly facing catch shoulder 86 and 87 to engage an upper surface of the engagement flange 57. The shelf 69 also has two upwardly extending arms 90 and 91 on either side of the opening 83 presenting arcuate pivot shoulders 88 and 89 adapted to engage the lower surface of the engagement flange 57. The engagement flange 57 is to be received between the catch shoulders 86 and 87 and the pivot shoulders 88 and 89 such that with arcuate movement of the presser member 61 relative the support member 60, the piston member 53 may slide in linear fashion relative the support member 60 axially relative the piston chamber forming element 52.

The catch fingers 84 and 85 are resilient and adapted to be deflected away from each other so as to permit the engagement flange 576 of the piston member 53 to move past their distal ends such that after the bottle 20 and pump mechanism 18 have been secured to the support member 60, the presser member 61 may be pivoted towards the support member 61 and the distal ends of the catch fingers 84 and 85 will engage the side or lower surfaces 144 of the engagement flange 57 and be biased apart such that the catch fingers 84 and 85 will come to be disposed with their catch shoulders 86 and 87 engaging the upper surface 143 of the engagement flange 57.

As best seen in FIG. 14, the support member 60 carries on its rear wall 66 two inwardly extending hook-like catch members 94 and 95 which are adapted to be received and to slide, when the actuator member 16 is in a closed position in two slots 96 and 97 provided in the rear wall 71 of the presser member 61. Each of these slots 96 and 97 have a blind end which forms catch members 98 and 99 to engage with the catch members 94 and 95 and prevent pivoting of the presser member 61 away from the support member 60 beyond a fully extended position similar to that shown in Figure X. The catch members 94 and 95 are resilient such that on initial folding of the actuator member 16 from the open position to past the fully extended position, the catch members 94 and 95 will deflect to pass past the catch members 98 and 99 and prevent subsequent unfolding of the actuator member 16 past a fully extended position similar to that shown in FIGS. 16, 17 and 18.

Catch members 94 and 95 on the support member 60 engage the catch members 98 and 99 on the presser member 60 and limit pivoting of the presser member 61 away from the support member 60 to a fully extended position and thereby against pivoting to a position in which the piston member 53 may be withdrawn from the piston chamber forming member 52.

Spring Member

Two elongate spring members 100 and 101 are provided on the support member 60 extending from the support member 60 to the presser member 61 and biasing the presser member 61 to pivot about the hinge axis 62 up towards the extended position. In this regard, the spring members 100 and 101 are cantilevered leaf spring members carried by the shelf 64 of the support member 60 and extending from a rear end on the shelf 64 forwardly and away from the shelf 64 such that the spring members 100 and 101 extend out of the plane of the shelf 64. The spring members have distal second forward ends 102 and 103 to engage slide ramps 105 and 106 provided on the presser member 61. The slide ramps provide slideways 107 and 108 between two upstanding locating curbs 109 on each side of each slideway which curbs 109 assist in guiding the distal ends 102 and 103 of the spring members in sliding longitudinally along the slideways 107 and 108.

FIG. 18 shows a fully extended position in which the distal end 102 of the spring member 100 engages a forward portion of the slideway 107. FIG. 19 shows a retracted position in which the distal end 102 of the spring member 100 engages a more rearward portion of the slideway 107 than in FIG. 18. In pivoting of the presser member 61 between the extended and retracted positions, the distal end 102 of the spring member 100 slides on the slideway 107.

Each spring member 100 and 101 is elongate about a longitudinal extending along the length of the spring member. Each spring member is deflected substantially normal to its longitudinal in moving between the extended position and the retracted position.

The slideways 107 and 108 are shown to be arcuate and inclined so as to be disposed further away from the support member 60 at the forward portion which the distal end 102 engages in the extended position than at the more rearward portion which the distal end 102 engages in the retracted position. This arrangement with the slotways being progressively further from the support member 60 with distance from the forward end of the slotway assists in reducing the deflection required of the spring members to bias the presser member 61 from the retracted position to the extended position.

As seen in FIGS. 14, 15 and 16, each spring member 100 and 101 has an open box-like construction with a pair of parallel side wall forming leg members 150 and 151 joined by a bridge wall-like bight 152 and with a cross-section normal the longitudinal of the spring member appearing of U-shape. Resiliency is preferably provided to the spring members by resilient deflection of opposed portions of the legs 150 and 151 towards and away from each other.

The longitudinal of the spring members lies in a plane normal to the hinge axis 62 and in deflection of the spring members between an unbiased condition and deflected conditions, the longitudinal of the spring member remains disposed in the same plane normal to the hinge axis.

The shelf 64 of the support member 60 has two elongate slots 109 and 110 formed therein and each of the spring members 100 and 101 as seen disposed longitudinally above these slots merging with the support shelf 64 at one end of the slots.

As best seen in FIG. 18, the support member 60 has an opening 111 in its rear wall 66 exposing an edge portion 112 of the support shelf 64. This edge portion 112 serves a catch surface for engagement by a catch shoulder 113 carried on the latch member 50 of the wall plate as seen in FIG. 1. On sliding of the assembled dispensing unit 12 downwardly onto the wall plate 14 with the bottle 20 to engage the wall plate 14, the latch member 50 snaps into catching engagement on the edge portion 112 to prevent upward sliding of the dispensing unit 12 relative to the wall plate 14. The presser member 61 has its rear wall extend forwardly inwardly in a central circular portion 113 which provides a vertical passageway 114 upwardly from the bottom of the presser member 61 for a person's finger to engage the latch member 50 and to displace it rearwardly to permit removal of the dispensing unit 12 from the wall plate 14 by upward sliding. Reinforcement of the support shelf 64 of the support member 60 proximate the edge portion 112 is provided by an upstanding downwardly extending semi-circular reinforcement flange 115 provided about the rear periphery of the opening 78.

In insertion of a bottle 20 onto the support shelf 64 of the support member 60, the catch ramp 33 on the bottom wall 27 of the bottle 20 is cammed and deflect the bottom wall 47 of the bottle upwardly as the bottle moves forwardly over the edge portion 112 until the catch ramp 33 becomes fully disposed within the rear portion 79 of the opening 78 at which point in time the catch ramp 33 snaps downwardly into the opening 78. As best seen in FIGS. 12 and 13, the catch ramp 33 has a forward, inclined ramping surface 116 and an arcuate vertical rear surface 117. Engagement between the rear surface 117 and the reinforcement flange 115 about the rear of the elongate opening 78 substantially prevents the bottle from being removed from engagement with the support member 60, at least without folding the actuator member 16 to an open position to access and forcibly direct the bottom wall 27 of the bottle 20 away from the support shelf 64. The rear surface 117 of the catch ramp 33 has a curved shape complementary to the curved shape of the rear of the opening 78 and its reinforcing flange 115. This serves to accurately locate and center the bottle 20 relative to the support member 60 and to prevent relative pivoting of the bottle 20 or relative sideways movement of the bottle 20 relative to the support shelf 64.

The preferred embodiment of the actuator member 16 illustrated in the Figures is preferably injection molded as a unitary element from relatively low cost plastic, preferably low density polyethylene. It is to be appreciated therefore that each of the elements forming the actuator member 16 are formed as an integral part thereof. The spring members 100 and 101 are particularly configured to provide adequate resiliency notwithstanding that inexpensive plastic such as low density polyethylene may be used. Such plastics are known to have poor resiliency in elasticity and to become permanently deformed through repeated bending and deflection or deformation.

The dispenser unit 12 is preferably adapted for use as a single use disposable unit which will be discarded once the material inside the bottle 20 has been dispensed. A typical bottle size is in the range of 0.5 to two liters and, typically, fluid is dispensed in allotments in the range of about 0.5 ml to 2 ml. Thus, for example, with a one liter bottle and 0.5 ml allotments, the spring members need to be capable of enduring about 2,000 cycles before they may fail. The spring members may preferably be designed so as to fail after a certain number of cycles as, for example, 25% or 50% or 100% more cycles than required to dispense fluid from a particular bottle so as to prevent re-use of the single use dispensing unit.

The dispensing unit 12 which is preferably for use as a single use disposable dispensing unit preferably is made from as few components as possible in order to reduce its cost. Accordingly, the actuator member 16 is being provided as a unitary element incorporating as part thereof the spring members, the living hinge, piston catch members and the other various elements. It is to be appreciated, however, that while the actuator member 16 is preferably a unitary element in accordance with the present invention, it may comprise a plurality of components. For example, rather than provide a living hinge 63 as shown in the preferred embodiment, the support member 60 and the presser member 61 may be substantially identical to that as illustrated but as two separate elements with each having complementary hinge forming elements which would permit each of the support member 60 and presser member 61 to be formed as separate elements and, for example, snap fitted together by their hinge forming elements to form a hinge therebetween.

The spring members preferably form an integral part of one of the support member 60 or presser member 61, however, this is not necessary and separate spring members could be provided. For example, one or more helical metal coil springs to be disposed between the support member 60 and the presser member 61 to bias them apart. Such separate spring members could be used either in embodiments where the support member 60 and the presser member 61 are a unitary element joined together by a living hinge or are separate elements.

The spring members 100 and 101 have been illustrated as coupled to the support member with a distal end engaging the presser member 61. It is to be appreciated that this could be reversed and the spring members could be provided coupled to the presser member 61 with distal ends of the spring members to engage the support member 60.

The preferred integral plastic spring members 100 and 101 are shown to extend with their longitudinal in a plane normal to the hinge axis 62. This is not necessary and similar elongate cantilevered leaf spring members could be provided which extend in other directions as, for example, to extend perpendicular to the direction in which the spring members are shown in the preferred embodiment.

Each of the support member 60 and the presser member 61 are provided to have a clam shell or box-like construction including a shelf and upstanding wall such that when the actuator member 16 is closed, an overlapping closed shell or box is provided which is closed and substantially encloses in an enclosed chamber defined therein the spring members, piston catch members and piston member. This is advantageous to prevent manual access inside the closed chamber and serves to enhance the feature that the dispensing unit, once assembled, cannot be disassembled or at least resists disassembly. In this regard, the bottle 20 by reason of its catch ramp 33 becoming engaged in effectively a snap fit within the opening 78 of the shelf 64 of the support member 60 substantially prevents the bottle after it has been coupled to the support member 60 from being removed. The actuator member 16, once it has been closed, resists being unfolded to an open position by reason of the catch members 94 and 95 on the support member 60 engaging the catch members 98 and 99 on the presser member 61. Thus, once the dispensing unit 12 is assembled to form an assembly of the bottle 20, pump mechanism 18 and actuator member 16 the dispensing unit 12 substantially cannot be disassembled or at least resists disassembly.

The dispensing unit 12 of the preferred embodiment is configured such that it must be in an assembled condition before it can be coupled to the wall plate 14.

While the dispensing unit 12 is coupled to the wall plate 14, the dispensing unit cannot be disassembled. In this regard, in order for the bottle 20 to be removed from the support plate 60, it is necessary that the support plate 60 slide horizontally rearwardly relative to the bottle. However, with the bottle 20 coupled at its rear to the wall plate 14, with the wall plate 14 extending from the bottle 20 downward immediately rearwardly of the support member 60, the wall plate 14 prevents rearward movement of the support member 60.

In the preferred embodiment, the assembled dispensing unit 12 is coupled to the wall plate 14 by the rear of the bottle 20 engaging the wall plate. In accordance with a modified form of the invention, the actuator member 16 and, particularly, the support member 60 thereof may also engage the wall plate 14 as, for example, by the rear wall of the support member 60 carrying its own mounting wedge similar to that provided on the bottle to be received in another wedge-shaped slot to be provided on the wall plate 14. Since the support member 60 and the wall plate 14 are to be performed by injection molding, a greater choice of coupling mechanisms for preferably slidably coupling of the support member 60 to the wall plate 14 may be provided.

In accordance with a further embodiment of the invention, rather than having the bottle 20 coupled to the wall plate 14, merely the support member 60 may be coupled to the wall plate 14 for mounting of the dispensing unit 12 to the wall plate 14.

The preferred bottle 20 is a substantially, non-collapsible, substantially rigid bottle formed by blow molding. This is preferred, however, the bottle could comprise a collapsible bottle or bag, however, since the appearance of a collapsing bottle or bag is generally considered to be unappealing, the use of a collapsible bottle or bag would likely require the provision of a housing about the collapsible bottle or bag which is undesirable in respect of cost and may render the dispensing unit more susceptible to disassembly.

The preferred embodiment of the dispensing unit 12 provides for the bottle 20 to be an enclosed container as is advantageous for shipment with the assembled dispensing unit 12 inverted. The bottle 20 preferably is vented through the pump mechanism 18 in use with air to be introduced into the bottle to replace material dispensed. This is not necessary and the bottle 20 may be provided with a suitable vent hole or port open in its top wall to the atmosphere.

The preferred embodiment illustrates the dispenser unit 12 as being arranged with a bottle inverted for gravity feed of material in the bottle to the piston pump mechanism for dispensing from the opening 30 disposed at the bottom of the bottle. This is preferred but not necessary and various inverted versions of the dispensing unit could be provided for use with piston pump mechanisms having a feed tube extend downwardly into a bottle from a piston pump mechanism disposed at an opening disposed at the top of the bottle and with a nozzle from the piston member 52 extending forwardly over the presser member 61 and then downwardly.

The bottle 20 is preferably blow molded from inexpensive plastic material preferably low density polyethylene so as to provide an inexpensive bottle. The functional features of the bottle 20 have been selected having regard to the nature of this plastic material from which it is preferably made. Difficulties are typically experienced in blow molding complex structures into bottles when low cost plastics are used. The preferred bottle has been selected to have a configuration particularly with the mounting wedge 34 configured to be a relative shape and size which can be formed by inexpensive blow molding techniques commonly used.

While the invention has been described with reference to preferred embodiments, many modifications and variations will now occur to a person skilled in the art. For a definition of the invention, reference is made to the following claims.

We claim:

1. A dispenser for flowable materials comprising:

a wall plate for mounting to a wall;

a dispensing unit for removably mounting to the wall plate;

the dispensing unit comprising an assembly of:

a bottle-like reservoir having an exit opening, a piston pump mechanism having a piston chamber forming element coupled to the opening of the reservoir and a piston member reciprocally slidable in the piston chamber forming element for reciprocal sliding to dispense flowable material from the reservoir through an extension of the piston member extending outwardly from the piston chamber forming element, an actuator member having a support member fixedly coupled to the reservoir about its opening and a presser member engaging the piston extension and pivotally coupled to the support member for movement between an extended position and a retracted position, with a spring member biasing the presser member to the extended position, wherein manual movement of the presser member between an extended and a retracted position slides the piston member in the piston chamber forming element to dispense flowable material from the extension of the piston element, wherein the spring member comprises an elongate member coupled at one first end to one of the presser member and the support member and with the second end engaging the other of the presser member and the support member.

2. A dispenser as claimed in claim 1 wherein the spring member together with at least one of the presser member and the support member comprise a unitary element injection molded from plastic.

3. A dispenser for flowable materials comprising:

a wall plate for mounting to a wall;

a dispensing unit for removably mounting to the wall plate;

the dispensing unit comprising an assembly of:

a bottle-like reservoir having an exit opening, a piston pump mechanism having a piston chamber forming element coupled to the opening of the reservoir and a piston member reciprocally slidable in the piston chamber forming element for reciprocal sliding to dispense flowable material from the reservoir through an extension of the piston member extending outwardly from the piston chamber forming element, an actuator member having a support member fixedly coupled to the reservoir about its opening and a presser member engaging the piston extension and pivotally coupled to the support member for movement between an extended position and a retracted position, with a spring member biasing the presser member to the extended position, wherein manual movement of the presser member between an extended and a retracted position slides the piston member in the piston chamber forming element to dispense flowable material from the extension of the piston element, wherein the spring member comprises an elongate cantilevered leaf spring member integrally formed from plastic by injection molding as a unitary element with the support member, the spring member extending along a longitudinal of the spring member from a first end thereof which merges into the support member toward the support member to a distal second end thereof, the spring member and the presser member engaging each other proximate the second end of the spring member, the spring member having an unbiased condition and being resiliently deflectable generally normal to its longitudinal to deflected conditions from which the spring member inherently attempts to return to its unbiased condition.

4. A dispenser as claimed in claim 3 wherein an elongate slideway is provided on the presser member for engagement by the second end of the spring member with the second end of the spring member sliding longitudinally on the slideway as the presser member and the support member pivot relative each other between the extended position and the retracted position.

5. A dispenser as claimed in claim 4 wherein the second end of the spring member engages the slideway proximate a first end of the slideway when the presser member and the support member are in the extended position and the second end of the spring member engages the slideway proximate a second end of the slideway when the presser member and the support member are in the retracted position, the slideway being disposed such that over an inclined portion of the slideway extending from the second end of the slideway towards the first end of the slideway, the slideway is disposed relative the presser member such that the slideway in any position of the presser member and the support member is progressively further from the presser member with distance from the first end of the slideway towards assisting in reducing the deflection required of the of the spring member to bias the presser member and the support member from the retracted position to the extended position.

6. A dispenser as claimed in claim 5 wherein the support member has a support shelf with an elongate slotway formed therein, the spring member disposed longitudinally in the slotway merging with the support shelf at one end of the slotway and extending out of the plane of the support shelf toward the second end of the spring member.

7. A dispenser as claimed in claim 6 wherein the spring member has in cross-section normal to its longitudinal, at least proximate with where it merges with the support member, a U-shape with two legs joined by a bight and the two legs being disposed substantially normal to the support surface.

8. A dispenser as claimed in claim 7 wherein the spring member is provided with resiliency substantially by the resilient deflection of opposed portions of the two legs towards and away from each other.

9. A dispenser as claimed in claim 3 wherein the support member is pivotally coupled to the presser member for pivoting about a hinge axis and the longitudinal of the spring member remains disposed in a plane normal to the hinge axis in deflecting between the unbiased condition and the defected conditions.

10. A dispenser as claimed in claim 9 wherein the support member, the presser member and the spring member together comprise a unitary element injection molded from plastic.

11. A dispenser for flowable materials comprising:

a wall plate for mounting to a wall;

a dispensing unit for removably mounting to the wall plate;

the dispensing unit comprising an assembly of:

a bottle-like reservoir having an exit opening, a piston pump mechanism having a piston chamber forming element coupled to the opening of the reservoir and a piston member reciprocally slidable in the piston chamber forming element for reciprocal sliding to dispense flowable material from the reservoir through an extension of the piston member extending outwardly from the piston chamber forming element, an actuator member having a support member fixedly coupled to the reservoir about its opening and a presser member engaging the piston extension and pivotally coupled to the support member for movement between an extended position and a retracted position, with a spring member biasing the presser member to the extended position, wherein manual movement of the presser member between an extended and a retracted position slides the piston member in the piston chamber forming element to dispense flowable material from the extension of the piston element, wherein the support member, the presser member and the spring member together comprise a unitary element injection molded from plastic, the presser member pivotally coupled to the support member by a living hinge for pivoting about a hinge axis, and the spring member comprises an elongate cantilevered leaf spring member coupled at one first end to one of the presser member and the support member and with a second end engaging the other of the presser member and the support member.

12. A dispenser for flowable materials comprising:

a wall plate for mounting to a wall;

a dispensing unit for removably mounting to the wall plate;

the dispensing unit comprising an assembly of:

a bottle-like reservoir having an exit opening, a piston pump mechanism having a piston chamber forming element coupled to the opening of the reservoir and a piston member reciprocally slidable in the piston chamber forming element for reciprocal sliding to dispense flowable material from the reservoir through an extension of the piston member extending outwardly from the piston chamber forming clement, an actuator member having a support member fixedly coupled to the reservoir about its opening and a presser member engaging the piston extension and pivotally coupled to the support member for movement between an extended position and a retracted position, with a spring member biasing the presser member to the extended position.

wherein manual movement of the presser member between an extended and a retracted position slides the piston member in the piston chamber forming element to dispense flowable material from the extension of the piston element, wherein the support member and the presser member together comprise a unitary element injection molded from plastic with the presser member pivotally coupled to the support member by a living hinge for pivoting about a hinge axis.

13. A dispenser as claimed in claim 12 wherein the presser member carrying piston catch members to engage the piston extension, the piston catch members integrally formed with the presser member from plastic by injection molding.

14. A dispenser as claimed in claim 12 wherein the hinge axis extending horizontally when the dispensing unit is mounted to a wall plate for use, the axis located at a forward portion of the actuator at a height below a height of the bottle, the presser member carrying a hand lever extending downwardly from the axis and presenting a forwardly directed surface for engagement by a user's hand to move the lever rearwardly and thereby move the presser toward the refracted position, the hand lever integrally formed with the presser member from plastic by injection molding.

15. A dispenser as claimed in claim 14 wherein the presser member has a shelf extending rearwardly from the lever, the shelf carrying the piston catch members.

16. A dispenser as claimed in claim 15 wherein the presser member carrying first catch members and the support members carrying complementary second catch members, the first and second catch members engaging each other to prevent pivoting of the presser member and the support member away from each other beyond the extended position, the first catch members and second catch members integrally formed with the presser member and the support member from plastic by injection molding.

17. A dispenser as claimed in claim 16 wherein the shelf of the presser member carrying the first catch members.

18. A dispenser as claimed in claim 16 wherein the spring member is disposed between the presser member and the support member and biases the support member and the presser member apart.

19. A dispenser as claimed in claim 12 wherein while the dispensing unit is coupled to the wall plate the dispensing unit cannot be disassembled.

20. A dispenser as claimed in claim 19 wherein the dispensing unit must be assembled before it is coupled to the wall plate.

21. A dispenser as claimed in claim 20 wherein once the dispensing unit is assembled, the dispensing unit resists disassembly.

22. A dispenser as claimed in claim 21 wherein when the dispensing unit is coupled to the wall plate, the reservoir has its exit opening directed downwardly to gravity feed the flowable material in the reservoir to the piston pump mechanism to dispense flow of material downwardly through the piston member, and wherein the actuator member is disposed below the bottle, the presser member being biased to an extended position in which the presser member is remote from the wall plate and in manual movement of the presser member from the extended position towards a retracted position moves towards the wall plate.

23. A dispenser as claimed in claim 12 wherein the dispensing unit is removably coupled to the wall plate by engagement between the reservoir and the wall plate.

24. A dispenser as claimed in claim 23 wherein the reservoir is formed by blow molding from low density polyethylene.

25. A dispenser as claimed in claim 24 wherein the reservoir removably couples to the wall plate by vertical sliding of the reservoir downwardly relative the wall plate with laterally spaced and laterally extending catch members on the wall plate being received in complementary laterally spaced and laterally extending slotways formed in a rearward portion of the reservoir during blow molding.

26. A dispenser as claimed in claim 12 wherein the reservoir removably couples to the wall plate by vertical sliding of the bottle downwardly relative the wall plate to engage a rear portion of the reservoir with the wall plate, the support member couples to the reservoir by movement of the support member forwardly relative the rear portion of the reservoir such that with the rear portion of the reservoir coupled to the wall plate, the support member cannot be disengaged from the reservoir.

27. A dispenser as claimed in claim 26 wherein when the dispensing unit is assembled, the piston pump mechanism is contained within the actuator member between the presser member and support member against disengagement from the reservoir.

28. A dispenser as claimed in claim 12 wherein the reservoir is a substantially non-collapsible bottle.

* * * * *